United States Patent [19]

Feroy

[11] 4,142,834

[45] Mar. 6, 1979

[54] ADJUSTMENT MEANS FOR ACHIEVING EQUAL CRANKPIN LOADING IN A CONTROLLABLE PITCH PROPELLER MECHANISM

[76] Inventor: Arne Feroy, 1921 S. 291st St., Federal Way, Wash. 98003

[21] Appl. No.: 803,122

[22] Filed: Jun. 3, 1977

[51] Int. Cl.[2] ..... B63H 3/08

[52] U.S. Cl. ..... 416/157 R; 416/167

[58] Field of Search ..... 416/157, 167

[56] References Cited

U.S. PATENT DOCUMENTS

| | | | |
|---|---|---|---|
| 2,355,039 | 8/1944 | Eves | 416/157 |
| 2,870,848 | 1/1959 | Liaaen | 416/157 |
| 2,913,057 | 11/1959 | Willi | 416/157 |
| 3,171,494 | 3/1965 | Liaaen | 416/167 X |
| 3,676,016 | 7/1972 | Feroy | 416/167 X |

FOREIGN PATENT DOCUMENTS

| | | | |
|---|---|---|---|
| 833630 | 3/1952 | Fed. Rep. of Germany | 416/157 |
| 860080 | 2/1961 | United Kingdom | 416/157 |

*Primary Examiner*—Everette A. Powell, Jr.
*Attorney, Agent, or Firm*—Christensen, O'Connor, Johnson & Kindness

[57] ABSTRACT

A controllable pitch propeller has a plurality of connecting rods running from a piston, through the end wall of a cylinder. The cylinder is affixed to a first set of blade turning crankpins forming part of a blade turning assembly. A piston, mounted for axial movement in the cylinder, is coupled to the connecting rods that in turn are connected to a second set of blade turning crankpins in the blade turning assembly. The piston and cylinder are relatively movable to rotate the blades through the crank pins. Due to normal tolerance variations during manufacture, the lengths of the total train of connections between the piston and the cylinder through the blade turning assembly are not identical, causing the length of the portion of the connecting rods protruding into the cylinder through the cylinder end wall to vary relative to the cylinder end wall. Adjustable members are provided at the connections between the connecting rods and the piston to adjust for the variable length in the connecting rods so that the length of the connections through the blade turning assembly are effectively equalized, resulting in equal loading on each of the connecting rods and crankpins when hydraulic pressure is applied to the piston.

14 Claims, 9 Drawing Figures

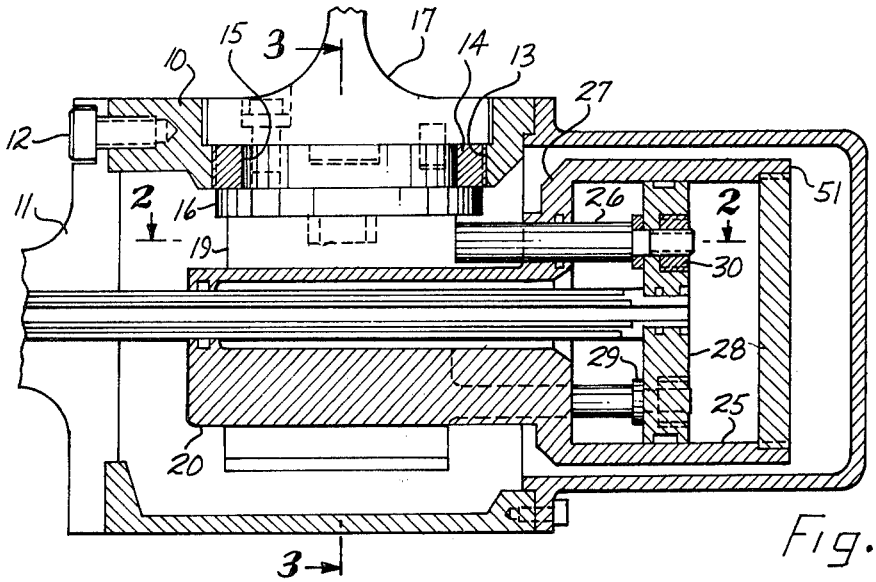
Fig. 1
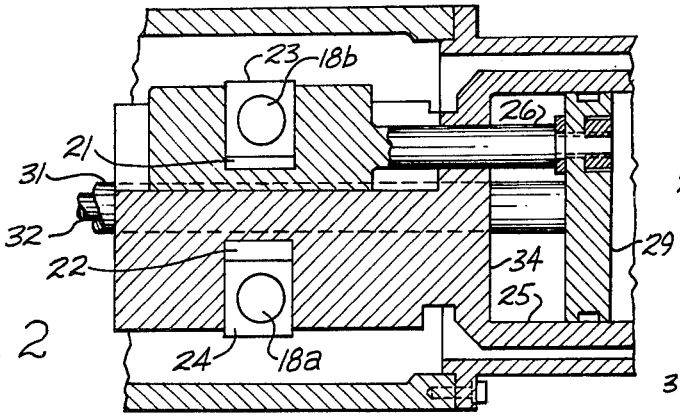
Fig. 2
Fig. 4
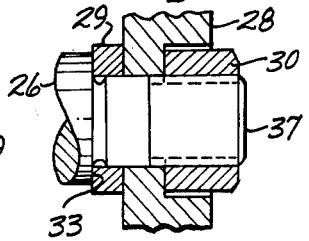
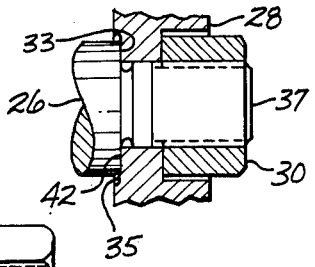
Fig. 5
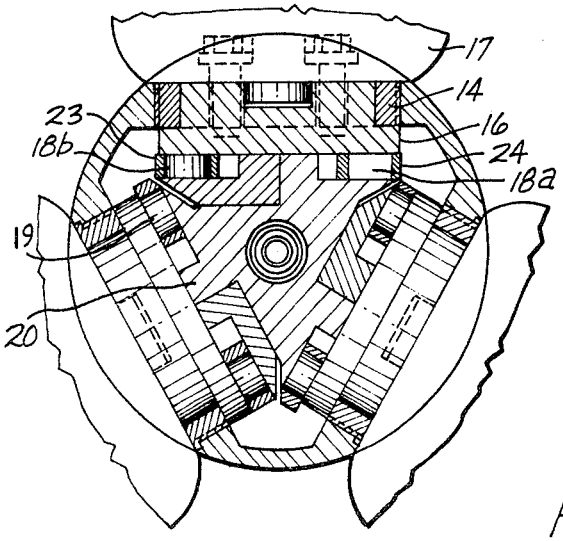
Fig. 3
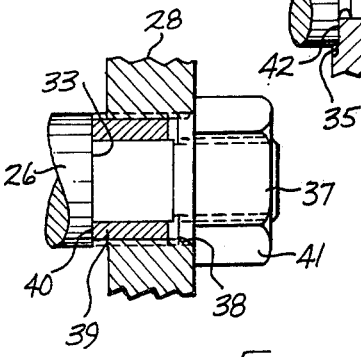
Fig. 6

ADJUSTMENT MEANS FOR ACHIEVING EQUAL CRANKPIN LOADING IN A CONTROLLABLE PITCH PROPELLER MECHANISM

BACKGROUND OF THE INVENTION

This invention relates to multiple blade, controllable pitch propellers of the class having two crankpins on each blade turning flange, and more particularly to means for achieving equal loading on the crankpins and crankpin linkages.

In controllable pitch propellers having two crankpins on each blade turning flange, the problem of equally loading the crankpins has always existed. The equal loading problem arises because the manufacturing accuracy necessary to make the various linkages equal in length (an absolute requirement in obtaining equal crank loading in such mechanisms) has heretofore been impossible to obtain. Prior attempts to achieve equal loading by the fitting and scraping of parts in the controllable pitch propeller have not been successful in obtaining linkages of the necessary equal length to provide equal crankpin and linkage loading. When the crankpin linkages in existing controllable pitch propeller assemblies are connected to the actuating mechanism (normally a hydraulic piston and cylinder) and tightened, some of the connections become tight while others are slack. Any attempt to fully tighten all the connections will overstrain some of the crankpin linkages while the remainder are merely snug. The parts that are overstressed during assembly will experience much higher loading during operation. Manufacturing inaccuracies in existing mechanisms result in placing most or all of th load onto one crankpin and its associated linkage, causing the mechanism to bind and become unworkable.

In my previous U.S. Pat. No. 3,676,016, I disclose a controllable pitch propeller having a double crank blade turning mechanism including a pivotable piston with self aligning connections to one set of crankpins to provide equal loading on all the crankpins. The structure described in my previous patent provides perfect, equal loading on the crankpins but comprises many parts, including a self-aligning connection to the actuating piston and, for propellers with four or more blades, including a secondary piston plate.

The principal object of this invention is to provide a controllable pitch propeller having a simplified, double crank blade turning mechanism with a single adjustment member in the connection between the actuating piston and one set of crankpins for taking up and compensating for the slack resulting from inherent manufacturing inaccuracies and to thus provide equal loading on all the crankpins.

Another object is to provide a double crank, blade turning mechanism having an adjustment member that automatically takes up slack in the mechanism when adjusted, that compensates for machining inaccuracies, is simple to install, and that provides equal loading on all crankpins.

Another object is to provide a single adjustment member to replace the plurality of shims and spacers used in conventional controllable pitch propellers, and the spherical washers and secondary piston plate disclosed in my previous patent.

Another object is to provide an adjustment member that is simply and easily adjusted to compensate for wear of the mechanism.

Other objects are to provide a mechanism that can be utilized on controllable pitch propellers having any number of blades and to provide a blade turning mechanism that has fewer parts than known controllable pitch propellers, that is of practical and durable construction, and that is simple and inexpensive to manufacture.

Still another object of the present invention is to provide a piston that can inherently compensate for unequal length crankpin linkages without the need for adjustment members and without overstressing the piston.

SUMMARY OF THE INVENTION

The foregoing objects, and other objects that will become apparent to one of ordinary skill upon reading the following specification, are provided in a controllable pitch propeller having a propeller hub and a plurality of blades radiating therefrom. Each of the blades has a flange mounting the blade for rotation about a radial axis relative to the hub. First and second crankpins are operably mounted on each of the flanges, forming a first set and a second set of crankpins. A relatively movable piston and cylinder is mounted within the hub. The piston has an inner face while the cylinder has an end wall oriented in mutually opposing relationship to the inner face of the piston. Means are provided for connecting the cylinder to the first set of crankpins. A plurality of connecting rods are operably coupled to the second set of crankpins, are slidably mounted in the end wall of the cylinder and extend in an axial direction relative to the cylinder toward the piston. In this environment, an improved means for rigidly coupling each of the connecting rods to the piston comprises a first means defining an abutment face associated with each of the connecting rods, a plurality of second means defining an abutment face associated with the piston, and a fastening means for rigidly affixing the connecting rods to the piston. Each abutment face on the piston corresponds to a respective abutment face on one of the connecting rods. The respective abutment faces on the connecting rods and the piston are in intimate contact when the connecting rods are rigidly affixed to the piston by the fastening means. In addition, the location of the abutment faces on the connecting rods and the piston are adjusted so that the distance from an orthogonal reference plane on the piston, preferably the inner of the piston, to a predetermined reference plane orthogonal to the axis of the cylinder, for example, the end wall of the cylinder, is equal at the location of each of the connecting rods. Thereby, each of the through connections from the piston, through the crankpins and back to the cylinder are adjusted so that they are effectively of equal length, causing the connecting rods and associated portions of the connection to be equally loaded when a working hydraulic pressure is applied to the piston.

In another aspect of the present invention, a novel piston is provided that is slidably mounted in the cylinder for axial movement relative to the cylinder. A means is provided for rigidly affixing each of the connecting rods to the piston at spaced locations on the piston. The thickness of the piston is chosen to withstand relatively high hydraulic working pressures and is further chosen so that the piston can easily deflect when a relatively low force is exerted on the piston, such as by clamping the connecting rods to the piston. Thus the piston itself, without the assistance of the improved adjustment means of the present invention can compensate for variations in length of the first and second connecting means by deflecting to substantially equalize the load on each of the connecting means. Moreover, the improved piston of the present invention can be utilized in conjunction with the adjustment means of the present invention to maintain equal loading on the connection means and the crankpins despite wear in the blade turning mechanism and connection means.

BRIEF DESCRIPTION OF THE DRAWINGS

FIG. 1 is a longitudinal, sectional view of a controllable pitch propeller hub;

FIG. 2 is a plan view partially in section on line 2—2 of FIG. 1;

FIG. 3 is a transverse section on line 3—3 of FIG. 1;

FIG. 4 is an enlarged detail section of the adjustment member between the crankpins and the piston;

FIGS. 5 and 6 are enlarged detail sections of other embodiments of the invention showing various adjustment members between the crankpins and the piston;

DETAILED DESCRIPTION

Figure 7:
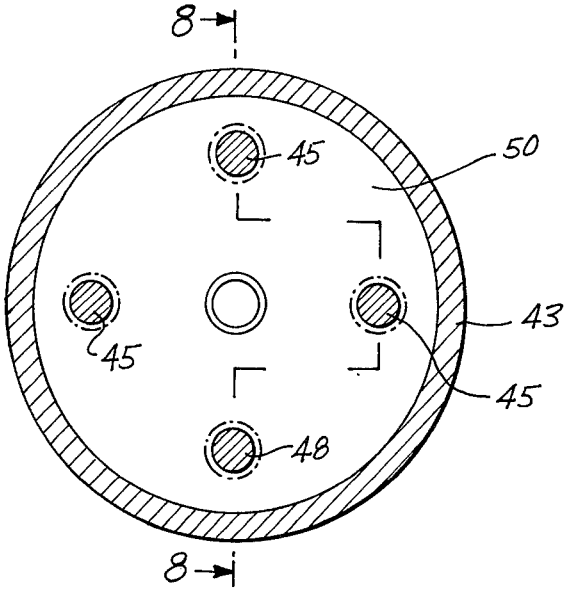
FIG. 7 is a cross-sectional view of the actuating piston and cylinder for a controllable pitch propeller hub illustrating another aspect of the present invention.

Referring to FIGS. 1, 2 and 3, propeller hub 10 is bolted to shaft 11 by capscrews 12. Propeller hub 10 is provided with threaded bore 13 which receives externally threaded bearing ring 14. Bearing ring 14 has bore 15 which receives flange 16 attached to propeller blade 17. Flange 16 is provided with two crankpins **18*a* and 18*b*. Crossheads 19 and 20 are slidable on the inner surface of flange 16 and have slots 21 and 22, respectively. Sliding block 23 is pivoted on one crankpin 18*b* of flange 16 and is slidable in slot 21 of crosshead 19. Sliding block 24 is pivoted on the other crankpin 18*a* of flange 16 and is slidable in slot 22 of crosshead 20. Crosshead 20 forms the forward end of cylinder 25. Connecting rod 26 of crosshead 19 is slidable in wall 27 of cylinder 25 and is further connected to piston 28 by spacer 29 and locknut 30. Tubes 31 and 32 are connected to piston 28 and have fluid outlets to the forward and aft portions, respectively, of cylinder 25**.

As shown in FIG. 3, the hub 10 also carries at least one additional bore, identical to bore 13, that carries an additional flange connected to a blade. Blade turning mechanisms identical to the one described are provided for each of the additional blades. Each of the additional blade turning mechanisms has a connecting rod (not shown) coupled to the piston. In the illustrated embodiment, the hub carries three blades and thus three blade turning mechanisms united by crosshead 20 through cylinder 25 and by three connecting rods affixed to the piston 28. For purposes of simplicity, only one of the blade turning mechanisms is described in detail. It is to be understood that the blade turning mechanisms for the remaining blades are substantially identical in construction and operation, with the possible exception of the means for connecting the connecting rods to the piston.

Still referring to FIGS. 1 through 3, fluid in lines 31 or 32 is directed to one side of piston 28, causing cylinder 25 to move in one direction and piston 28 to move in the opposite direction. Cylinder 25, which is connected by crossheads 20 and sliding blocks 24 to one set of crankpins **18*a*, and piston 28, which is connected by crossheads 19 and sliding blocks 23 to the other set of crankpins 18*b*, coact to rotate flanges 16 and propeller blades 17** to vary the pitch of the propeller from full pitch ahead to full pitch astern and vice versa.

In order to provide equal loading on the crankpins **18*a* and 18*b*, the piston must bear with equal force on the several connecting rods 26**. This is possible only if (1) similar parts of the different linkages from the crankpins to the piston are made identical with respect to size, dimensions, tolerances and clearances; or (2) if an adjustment means or device is provided for each linkage to compensate for the normal machining tolerances and inaccuracies. The former is possible only in theory since a machining tolerance is required to make the parts, and because a clearance between moving parts is needed in order to make them operable and to provide lubrication between the parts.

In accordance with the present invention, the various parts of the blade turning mechanism are designed for and constructed by conventional manufacturing methods. Referring to FIGS. 1 and 4, piston 28 is attached to connecting rod 26 with spacer 29 and locknut 30. Spacer 29 has an abutment surface that bears against the abutment surface 33 of connection rod 26 and forms a solid part on which piston 28 abuts by the force of locknut 30. The abutment surface 33 is formed by a shoulder that is created by the reduced diameter end portion 37 on each of the connecting rods. The end portions 37 extend through respective, mutually aligned bores in the piston and have external threads for receiving locknuts 30.

During assembly, the cylinder, crossheads and other internal hub parts are inserted into the hub. Before the piston is installed, the distance from surface 33 (formed by the shoulder on the connecting rod) of each connecting rod 26 to any orthogonal reference plane relative to the axis of the cylinder is measured, for example, end wall surface 34 or surface 51 of cylinder 25. This measurement will invariably differ with the various connecting rods as a result of machining tolerances in the crankpin linkages, as explained above. Accordingly, spacer 29 is made to match the variations in the measured distances so that, upon assembly, the total distance from surface 34 of cylinder 25 to the mutually opposing surface of the piston 28 is the same for all connecting rods. With the correct length spacer 29 in place, piston 28 is positioned over end 33 of connecting rods 26 and locked into place by locknut 30.

It is to be understood that the above measurement can be taken from surface 33 of each connecting rod 36 to any common and convenient transverse, preferably orthogonal, reference plane in the mechanism. For example, end surface 51 of cylinder 25 may serve as an equally effective reference plane from which the measurements can be taken. The distance between the chosen orthogonal reference plane, for example, surface 34, of the cylinder and the abutment surface 33 on the connecting rod can be measured to within 0.0005 inch using conventional measuring tools, and since spacer 29 is flat, it can easily be machined to have a thickness within a tolerance of 0.00025 inch. Thus a spacer 29 can be matched to each of the connecting rods to provide an equal spacing from the cylinder wall, for example, to piston 28 at all connecting rods, thereby equalizing the lengths of the crankpin linkages and insuring that piston 28 bears with equal force on all the connecting rods.

A second embodiment of the adjusting device is illustrated in FIG. 5. In this embodiment, the distance from surface 33 of each connecting rod 26 to reference surface 34 of cylinder 25 is measured. To compensate for any variation in the measured lengths and to insure that the piston is made to bear with equal force on the several connecting rods, piston 28 is provided with recessed bore 35 into which the shoulder that forms the surface 33 is inserted. Similar bores in the piston are provided for each of the remaining connecting rods. The depth of each of the bores 35 for each of the connecting rods is adjusted so that the distance from the reference surface 34 of the cylinder end wall to the opposing surface 42 of the piston 28 is equal at the location of each of the connecting rods. Upon installing piston 28, abutment surface 42 of recessed bore 35 will bear on abutment surface 33 of the connecting rod. The piston is then locked in place by locknut 30. When all connecting rods are fastened to the piston, each will be equally loaded during operation.

In another embodiment of the adjusting device illustrated in FIG. 6, piston 28 is provided with an internally threaded bore 38. Externally threaded sleeve 39 slides over the reduced diameter end portion 37 of the connecting rod and engages the threads in piston 28. The annular end of the sleeve 38 facing the connecting rod forms an abutment surface 40 associated with the piston. When the sleeve 39 is advanced through the threads in piston bore 38, it engages the surface 33 of connecting rod 26. Bores similar to piston bore 38 are also provided in the piston 28 for each of the remaining connecting rods. Sleeves similar to sleeve 39 are threadably engaged in the bores and abutted against the abutment surfaces on their respectively aligned connecting rods. When all of the sleeves are threaded to engage the abutment surfaces on the respective connecting rods, the piston 28 is positioned in the exact same axial location with respect to all the connecting rods and to surface 34 of the cylinder. A locknut 41 is threaded onto each of the connecting rod ends to lock the piston in place.

FIGS. 4, 5 and 6 illustrate three separate adjustment methods for the connection between the crankpins and the piston. Each method provides a solid and rigid connection in which the piston is attached to the several connecting rods with equal force, and with no distortion of any of the parts. All connections make use of a single adjustment member for each connecting rod as a substitute for the shims, spacers, washers and the like commonly employed in the linkages between the actuator and the crankpins in controllable pitch propellers. In the embodiments shown in FIG. 4, the single member is spacer 29 whose thickness is easily determined by measurement, while in the embodiment shown in FIG. 5, the recessed bore 35, the depth of which is determined by a single measurement on each connecting rod, constitutes the single adjustment. Both embodiments insure equal distance between the cylinder end wall or other orthogonal reference plane and the piston at each of the connecting pins, and thus provides for equal loading on all crankpins and crankpin linkages.

In the embodiment shown in FIG. 6, no machining of any part is required upon assembly. The sleeve 39, when advanced in the threads 38 of piston 28, abuts the shoulder 33 and thus automatically provides the correct spacing of piston 28 from the cylinder end wall to yield loading on the several connecting rods and the crankpins.

As background for another aspect of the present invention, all other known conventional, double crank controllable pitch propellers (with the exception of the structure disclosed in U.S. Pat. No. 3,676,016) employ a piston that is connected to a single, centrally located piston rod, which receives the hydraulic load of the piston and transmits it to the several crankpins. This particular type of loading, i.e., a hydraulic piston being supported on or near the center, requires that the piston be made very heavy with a thick cross-section in order to withstand the high bending stresses associated with this type of loading.

In the present invention, however, the piston is connected to the various crankpins via several connecting rods that are slidable in the end wall of the cylinder. The connecting rods are connected to the piston substantially at the center of the pressure loading area on the piston for each of the different connecting rods. The hydraulic force acting on the piston is therefore more evenly distributed over the piston.

The type of loading of the piston in the present invention does not create the large stresses found in pistons of conventional controllable pitch propellers. As a result, the piston need only be as thick as that required by strength considerations for this type of loading, and therefore sized so that it can deflect to contact and be supported by all the connecting rods.

Figure 9:
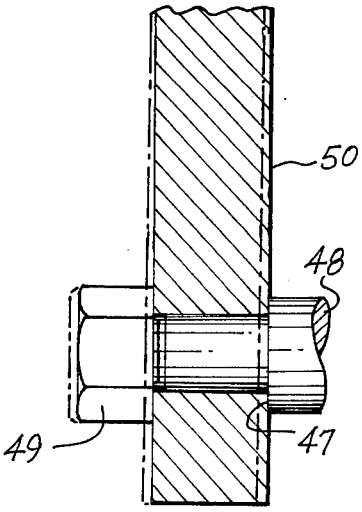
FIG. 9 is an enlarged detail view of FIG. 8 showing a connection between a connecting rod and the piston.
Figure 8:
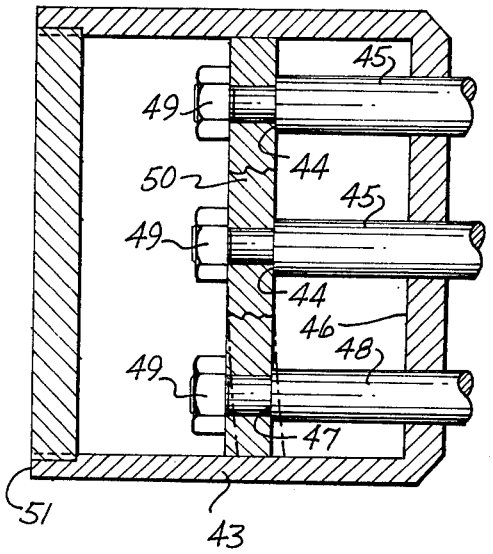
FIG. 8 is a staggered, longitudinal sectional view taken along section line 8—8 of FIG. 7.

Referring to FIGS. 7, 8 and 9, the piston 50 is slidably mounted in the cylinder 43 for movement in an axial direction relative to the cylinder. For purposes of illustration, it is assumed that the distance from abutment surface 44 on each of the upper three connecting rods 45 to the surface 46 of the cylinder end wall is equal and that the distance from the abutment surface 47 of the remaining connecting rod 48 is slightly less than the corresponding distances for the remaining connecting rods 45.

When the locknuts 49 are tightened down, the abutment surfaces on all the connecting rods will be contacting the corresponding abutment surfaces on the piston. However, each of the upper connecting rods will be under a small compression load relative to a neutral or tension load in the upper connecting rod 48. The piston is sized in the axial dimension in accordance with the present invention so that, when a force is applied to the piston by the tightening of locknuts 49, the piston will easily deflect to contact the abutment surfaces on all the connecting rods. As an example, assume a controllable pitch propeller having four blades and a piston with a 19 inch diameter. If the four connecting rods are manufactured by conventional methods, they will be unequal in length. Assume, for example, that one connecting rod is 0.006 inch shorter than the others. In order for the piston to bear equally on all connecting rods, the piston must deflect 0.006 inch in one sector. When the piton is made with a thickness of 1.25 inch, for example, a force equivalent to a pressure of only 60 pounds per square inch (PSI) or less on the piston is required for deflect it the necessary 0.006 inch. Considering a working pressure of 1000 PSI when the propeller is fully loaded, the pressure equivalent to the force required to deflect the piston to contact the short connecting rod is only 6% of the working pressure. Thus the piston can deflect and provide substantially equal loading on the connecting rods at the normal working pressures without being overstressed.

It is understood that any of the adjustment devices and methods herein described and illustrated in FIGS.

4, 5 and 6 can be employed independently, or used in combination with a piston that is allowed to deflect to jointly insure equal loading on the connecting rods and on the crankpins. Furthermoe, providing the difference in the distances from surface 34 of the cylinder, or from any convenient reference plane orthogonal to the cylinder axis, to surface 33 of the connecting rod (for the different connecting rods) is not in excess of the deflection which the piston can sustain without being unduly stressed, the piston can be employed wihout the use of an adjustment device to achieve the same result.

While only three specific embodiments of the adjustment means for equally distribututing the load on the piston among the several connecting rods are shown, it is to be understood that other equally effective adjustments based upon the measurement of machining discrepancies may be applied with the same end result. For example, by providing threads on the end of the connecting rod and an adjustable locknut on each side of the piston, the piston can be positioned to load the connecting rods equally. Thus, it is intended that the grant of Letters Patent hereon be limited only by the definition contained in the appended claims and equivalents thereof.

What is claimed is:

1. In a controllable pitch propeller having a propeller hub and a plurality of blades radiating therefrom, a blade turning mechanism comprising a flange on each blade and operably seated in said hub, first and second crankpins on each flange, an axially movable cylinder in said hub, operable connections between said cylinder and the first crankpins, and an axially movable piston in said cylinder, operable connections between said piston and said second crankpins, the connections between said piston and said second crankpins being slidable in a wall of said cylinder, an improvement comprising an adjustment means for connecting said piston to said connections with equal loading, said adjustment means being sized and constructed so as to provide equal spacing at each of said connections between said piston and a predetermined reference plane oriented orthogonally to the axis of said cylinder.

2. The improvement of claim 1 wherein said connections between said piston and the second crankpins each comprise a connecting rod connected to said piston and extending through said wall of said cylinder, said adjustment means comprising a spacer interposed between an abutment surface on at least one of the connecting rods and said piston, said plane being defined by the surface of said end wall opposing said piston, the axial dimension of said spacer being chosen so that the combined dimension of the distance from the surface of the wall of said cylinder to the abutment surface on the connecting rod and the axial dimension of said spacer is equal to the corresponding combined dimension for each of the remaining connecting rods, thereby compensating for normal machining inaccuracies in said connections and providing equal loading on all said connections.

3. The improvement of claim 1 wherein said connections between said piston and said second crankpins each comprise a connecting rod connected to said piston, and a shoulder on said connecting rod, said adjustment means comprising means defining a recess in said piston having a bottom surface corresponding to at least one of the connecting rods, said recess being constructed and located so that said bottom surface abuts said shoulder on said connecting rod, said plane being defined by the surface of said end wall opposite said piston, the depth of said recess being constructed so that the combined dimension of the distance from the cylinder wall surface to the abutment surface on a given connecting rod less the depth of the corresponding recess relative to the surface of said piston opposing said cylinder wall is equal to the corresponding combined dimension for the remaining connecting rods, thereby compensating for normal machining inaccuracies and providing equal loading on all said connections.

4. The improvement of claim 1 wherein said connections between said piston and said second crankpins each comprise a connecting rod connected to said piston, and a shoulder on said connecting rod, said piston having an internally threaded bore aligned coaxialy with said connecting rod, said adjustment means comprising an externally threaded sleeve threadably engaging said threaded bore, an abutment face on said threaded sleeve, said threaded sleeve being threaded into said bore until the abutment face thereon abuts said shoulder of said connecting rod.

5. In a controllable pitch propeller having a propeller hub and a plurality of blades radiating therefrom, each of said blades having a flange mounting the blade for rotation about a radial axis relative to said hub, first and second crankpins operably mounted on each of said flanges, said first crankpins forming a first set of crankpins and said second crankpins forming a second set of crankpins, a relatively movable piston and cylinder, said piston having an inner face, said cylinder having an axis and an end wall, means connecting said cylinder to said first set of crankpins, and a plurality of connecting rods operably coupled to said second set of crankpins, said connecting rods being slidably mounted in the end wall of said cylinder and extending in an axial direction relative to said cylinder and toward said piston, an improved means for rigidly coupling each of said connecting rods to said piston comprising:

first means defining an abutment face associated with each of said connecting rods, a plurality of second means defining an abutment face associated with said piston, each abutment face on said piston corresponding to a respective abutment face on one of said connecting rods, and fastening means for rigidly affixing said connecting rods to said piston, said respective abutment faces on said connecting rods and said piston being in intimate contact when said connecting rods are rigidly affixed to said piston, the location of said abutment faces being adjusted so that the distance from a predetermined reference plane oriented orthogonally to the axis of said cylinder to the inner face of said piston is equal at each of said connecting rods.

6. The improvement of claim 5 wherein said first means comprises a shoulder on each of said connecting rods formed by a reduced diameter portion extending axially from the end of said connecting rod, the abutment face being formed by the surface of said shoulder oriented transversely to the axis of said connecting rod.

7. The improvement of claim 6 wherein each of said second means comprises an annular spacer movable relative to said piston and slidable over the reduced diameter portion of a respective connecting rod, the thickness of said spacer in the axial dimension being chosen to provide said equal distance.

8. The improvement of claim 6 wherein each of said second means comprises means defining a recess in said piston having a bottom surface forming said abutment face, each said recess being constructed and oriented so that the bottom surface of said recess abuts the abutment face of a corresponding connecting rod, said piston having a plurality of bores aligned with said reduced diameter portions on respective ones of said connecting rods, the depth of each recess being chosen to provide said equal distance.

9. The improvement of claim 6 wherein said piston has a plurality of internally threaded bores, each of which are axially aligned with a respective one of said reduced diameter portions on said connecting rods, and wherein said second means comprises an externally threaded sleeve threadably engaging a respective one of said internally threaded bores, each said sleeve having a central bore slidably engageable with the reduced diameter portion of a respective connecting rod, said sleeve having an annular abutment face defining a plane oriented generally perpendicularly to the axis of its respective connecting rod, the abutment face of said sleeve being capable of protruding beyond the inner surface of said piston toward the wall of said cylinder, each sleeve being threaded into said bore until the abutment face thereon abuts the abutment face of a respective connecting rod.

10. In a controllable pitch propeller having a hub and a plurality of blades radiating therefrom, a blade turning mechanism comprising a flange on each of said blades mounting said blades on said hub for rotation about a generally radial axis relative to said hub, each flange having first and second blade turning crankpins, a cylinder associated with said blade turning mechanism, first connecting means for operably connecting said cylinder to each of said first crankpins, second connecting means operably connected to the second crankpins for connecting said second crankpins to a piston, said second connecting means including connecting rods coupled to each of the second crankpins and slidably mounted in and extending through an end wall of said cylinder, a first connecting means and a second connecting means coupled to a first and second crankpin on a given flange forming a set of first and second connecting means, the improvement comprising:

a piston slidably mounted in said cylinder for axial movement relative thereto and means for rigidly affixing each of said connecting rods to said piston at spaced locations on said piston, the thickness of said piston being chosen so that said piston can deflect upon being rigidly affixed to said connecting rods to compensate for variations in the dimensions of each of the sets of first and second connecting means and thereby subtantially equalize the load on each of said sets.

11. In a controllable pitch propeller having a hub and a plurality of blades radiating therefrom, a blade turning mechanism comprising a flange on each of said blades mounting said blades on said hub for rotation about a generally radial axis relative to said hub, each flange having first and second blade turning crankpins, a cylinder associated with said blade turning mechanism, first connecting means for operably connecting said cylinder to each of said first crankpins, second connecting means operably connected to the second crankpins for connecting said second crankpins to a piston, said second connecting means including connecting rods coupled to each of the second crankpins and slidably mounted in and extending through an end wall of said cylinder, a first connecting means and a second connecting means coupled to a first and second crankpin on a given flange forming a set of first and second connecting means, the improvement comprising:

a piston slidably mounted in said cylinder for axial movement relative thereto and means for rigidly affixing each of said connecting rods to said piston at spaced locations on said piston, the thickness of said piston being chosen to withstand relatively high hydraulic working pressure and being chosen so that a portion of said piston can deflect upon being affixed to said connecting rods to compensate for variations in the dimensions of the first and second connecting means and thereby substantially equalize the load on each of said connecting means, and adjustment means for connecting said piston to said connections with equal loading, said adjustment means being sized and constructed so as to provide substantially equal spacing between said piston and the wall of said cylinder.

12. The improvement of claim 11 wherein said adjustment means comprises:

first means associated with each of said connecting rods defining an abutment face thereon, a plurality of second means defining an abutment face associated with said piston, each abutment face on said piston corresponding to a respective abutment face on one of said connecting rods, fastening means for rigidly affixing said connecting rods to said piston, said respective abutment faces on said connecting rods and said piston being in intimate contact when said connecting rods are rigidly affixed to said piston, the location of each of said abutment faces on said piston being adjusted so that the distance from the inner face of said piston to a reference plane oriented orthogonally relative to said cylinder is equal at each of said connecting rods.

13. In a controllable pitch propeller having a propeller hub and a plurality of blades radiating therefrom, each of said blades having a flange mounting said blades for rotation about a radial axis relative to said hub, first and second crankpins operably mounted on each of said flanges, said first crankpins forming a first set of crankpins and said second crankpins forming a second set of crankpins, an hydraulic cylinder, said cylinder having an axis, an end wall, and a reference plane oriented in orthogonal relationship to the axis of said cylinder, means connecting said cylinder to said first set of crankpins, and a plurality of connecting rods operably coupled to said second set of crankpins, said connecting rods being slidably mounted in the end wall of said cylinder and extending axially into said cylinder, the improvement comprising:

a piston slidably mounted in said cylinder having an inner face oriented in parallel, mutually opposing relationship to said end wall, said connecting rods having abutment faces opposing respective abutment surfaces on said piston, the distance of said rod abutment faces from said reference plane varying slightly among said connecting rods, said piston being sized and constructed so that said piston can flex in the axial direction upon being affixed to said connecting rods and thereby provide substantially equal loading on all connecting rods and all crankpins when hydraulic pressure is applied to said piston, and means for affixing each of said connecting rods to said piston to place the respective abutment faces on said connecting rods and said piston in intimate contact.

14. The improvement of claim 13 wherein each of said abutment faces on said piston and said connecting rods is located in the axial direction relative to said cylinder so that the distance from the cylinder end wall to the inner face of said piston is equal at each of said connecting rods.

* * * * *